United States Patent [19]

Krasser et al.

[11] Patent Number: 4,516,098

[45] Date of Patent: May 7, 1985

[54] OVERCURRENT PROTECTION SWITCH

[75] Inventors: Fritz Krasser, Altdorf; Josef Kinner, Burthann, both of Fed. Rep. of Germany

[73] Assignee: Ellenberger & Poensgen GmbH, Altdorf, Fed. Rep. of Germany

[21] Appl. No.: 478,983

[22] Filed: Mar. 25, 1983

[30] Foreign Application Priority Data

Mar. 26, 1982 [DE] Fed. Rep. of Germany ..... 3211246

[51] Int. Cl.[3] ..... H01H 73/48

[52] U.S. Cl. ..... 335/35; 335/23; 335/191

[58] Field of Search ..... 335/23, 35, 38, 39, 335/43, 44, 18, 173, 21; 337/60, 66, 68, 70, 71, 35, 38, 54, 55

[56] References Cited

U.S. PATENT DOCUMENTS

| | | | |
|---|---|---|---|
| 2,797,276 | 6/1957 | Ponsy | 335/38 |
| 2,913,542 | 11/1959 | Myers . | |
| 3,365,682 | 1/1968 | Fujita | 335/23 |
| 3,451,016 | 6/1969 | Ellenberger | 337/66 |
| 4,167,720 | 9/1979 | Krasser | 337/60 |
| 4,206,430 | 6/1980 | Rusch et al. | 335/35 |

FOREIGN PATENT DOCUMENTS

| | | |
|---|---|---|
| 744559 | 1/1944 | Fed. Rep. of Germany . |
| 2505449 | 8/1975 | Fed. Rep. of Germany . |
| 2721162 | 11/1978 | Fed. Rep. of Germany . |
| 1008876 | 11/1965 | United Kingdom . |

*Primary Examiner*—E. A. Goldberg
*Assistant Examiner*—George Andrews
*Attorney, Agent, or Firm*—Spencer & Kaye

[57] ABSTRACT

An overcurrent protection switch having one or more thermal and/or magnetic trips (14,21) and a mechanical switch latch which essentially consists of an actuating element and a latching lever (6) which acts in conjunction with the former and which with its first end acts upon a plunger (8) which is guided in the longitudinal direction of the housing (69) under an initial spring tension and which drives the switching contacts, and which latching lever rests with its other end in the latching position under an initial spring tension on a support area (13) of a trip lever (9), wherein, for improving the switching-off characteristics and the handling characteristics of the switch, the trip lever (9) is constructed as an essentially L-shaped angle lever which in the area of its angle is rotationally supported on a shaft (75) which is stationary with respect to the housing, which lever is subjected to an initial spring tension with respect to the thermal and/or magnetic trip (14,21) and which engages with the swivel end (27) of the first L leg through a longitudinal groove in the plunger 8 and which is provided at the swivel end of the second L Leg, which runs essentially parallel to the plunger (8) and projects from the rotational point in the direction of the actuating element (toggle 2), with the support area (13).

17 Claims, 9 Drawing Figures

Figure 2:
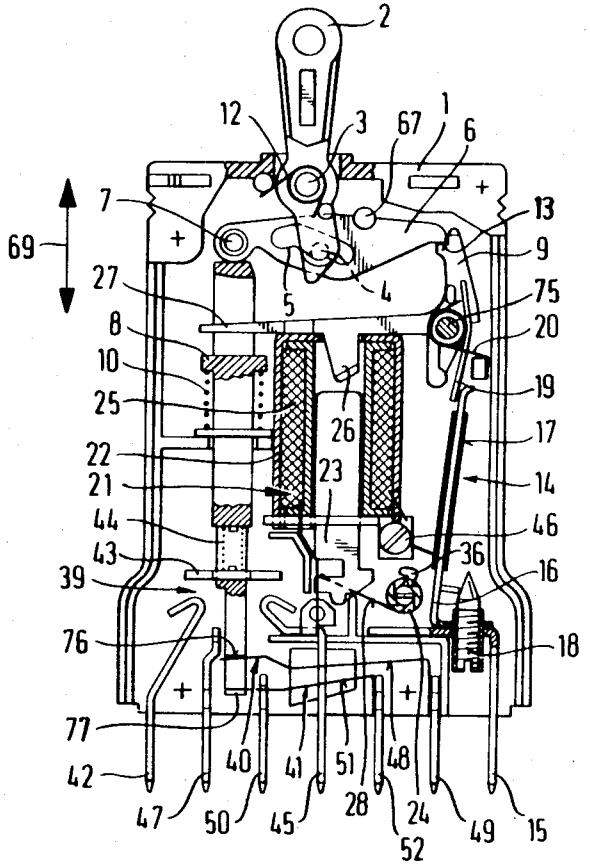

56
13
9
62
57
68
54
6
65
67
65
5
13
67
75
9
7
63
68
26
6
27
5
75
7
26
27

OVERCURRENT PROTECTION SWITCH

The invention relates to an overcurrent protection switch having the features of the preamble of claim 1. Such a switch is the subject of British Pat. No. 1,008,876.

The invention is based on the object of improving the switching off characteristics of such a switch by means of striker armature action on the contacts. This object is achieved by means of the characterizing features of claim 1.

The angle lever-type trip lever which with the swivel end of its one L leg engages through a recess in the plunger causes the contacts disposed at the plunger to be opened more rapidly since the plunger, as a result of the force of the spring acting on it, is accelerated not only when it is released by the latching lever but has imparted to it an additional acceleration by the swivel end. In the case of tripping, the swivel end impinges against the end of the plunger groove facing the latching lever resulting in a more sudden opening of the switching contacts. This improves the burning-off characteristics of the switching contacts and the switching capacity which, among others, depends on these characteristics. In addition, the switch latch arrangement which essentially consists of only two parts is constructed to be relatively simple which in the final analysis increases the switching reliability of the apparatus.

The instructions incorporated in the characterizing features of claim 2 show, in conjunction with the features of claim 1, a transmission, which is known per se from DE-OS No. 2,721,162 and which is particularly simple and in addition guarantees a free tripping of the apparatus, of the movement of the actuating element constructed as a two-armed toggle to the latching lever.

The characteristic feature of claim 3 provides not only the possibility of locking the switch or the primary contacts of the switch in an on or off position, one or more secondary contact pairs being closed when the primary contacts are open and vice versa, but also of bringing the actuating element and in association with it all parts of the switch latch or of the contact arrangement, respectively, also into an intermediate position and of locking it there in which position all contact pairs are open. This intermediate position can be reached and locked both from the on position and from the off position.

As a result of the characteristic feature of claim 5, on the one hand, the essential movable parts of the switch latch which in the case of tripping are subjected to high acceleration forces are constructed to have relatively low mass so that the switching off can take place even more rapidly and thus more reliably.

On the other hand, the construction especially of the switch latch parts listed in claim 5 has the result that in the switch part which is provided with the actuating element and which in its installed condition must be accessible to the layman no current-conducting parts are disposed. This provides an additional protective measure or insulating measure which far exceeds the relevant VDE regulations.

The measure of claim 6 produces an improved striker armature action since the striker armature which can be longitudinally displaced in the coil former of the magnetic trip is given a certain time to advance before it impinges on the center region of the trip lever and hits the latter upwards so that this trip lever, in turn, can act upon the plunger and the contacts provided thereon in the manner already described.

Due to the fact that the yoke is mounted in a releasable manner on the coil former of the magnetic trip as claimed in claim 7, it is possible to operate the magnetic trip as required with and without yoke. This makes it possible to achieve in a selective manner a considerable influence on the magnetic flux in the coil thus making it possible to achieve a coarse adjustment of the tripping characteristics of the magnetic trip. The fine adjustment of these tripping characteristics is done by means of a spring force as claimed in claim 8 which, for example, is achieved by means of a spring. The spring setting can be adjusted very finely by means of the adjusting device described in claims 9–11 and essentially known from DE-OS No. 2,505,449.

The instruction of claim 12 shows a particularly space-saving arrangement of the bimetallic strip and the effect of an action of the latter via a compensating bimetallic strip known per se on the trip lever.

Such overcurrent protection switches are frequently assembled with further adjacent switches to form multipole apparatuses. This involves the requirement that if only one pole or one phase is tripped the other phases also trip. As a rule, this has hitherto been achieved by means of a so-called external mechanical coupling of the actuating elements. The instruction in claim 13 now shows a more direct and more rapid coupling (internal coupling)—essentially known from U.S. Pat. No. 2,913,542—of the tripping movements of the adjacent switch latches by means of a coupling element which lies between the apparatuses and which is not accessible to the layman and cannot be influenced by him. These so-called trip couplers are constructed as claimed in claim 14 in a particularly functional and simple manner and can be inserted as required between the individual apparatuses installed adjacent to one another.

Finally, the instruction of claim 16 shows a manner known per se, which is simple to produce and has particular electrical operational reliability, of the contact arrangement in the apparatuses.

Figure 1:
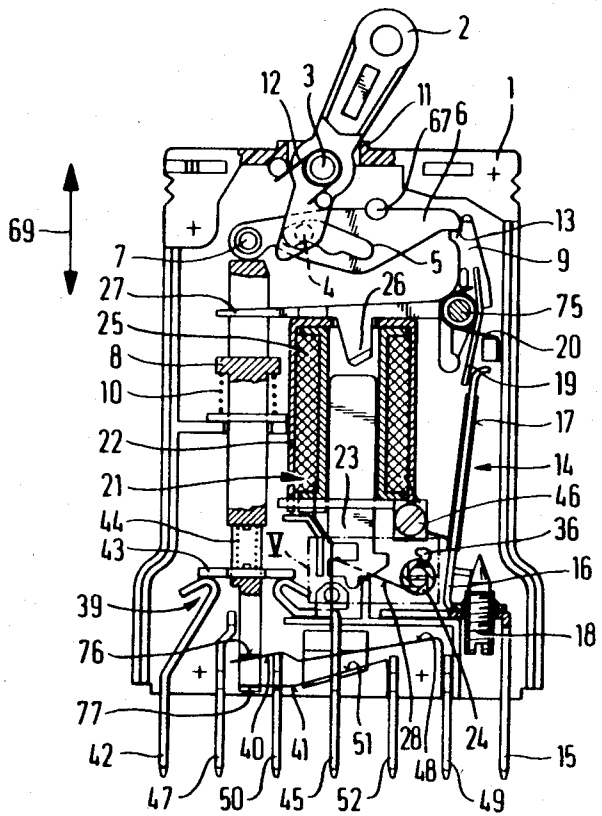
Figure 4:
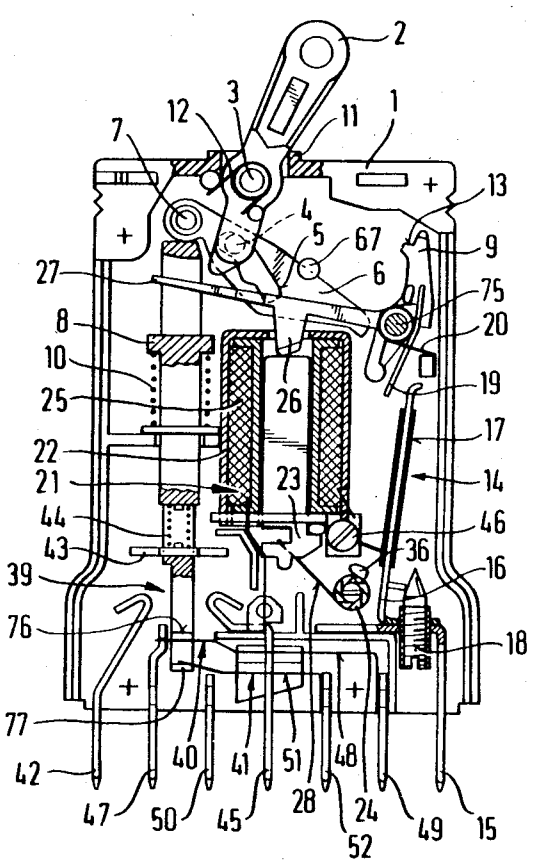
Figure 3:
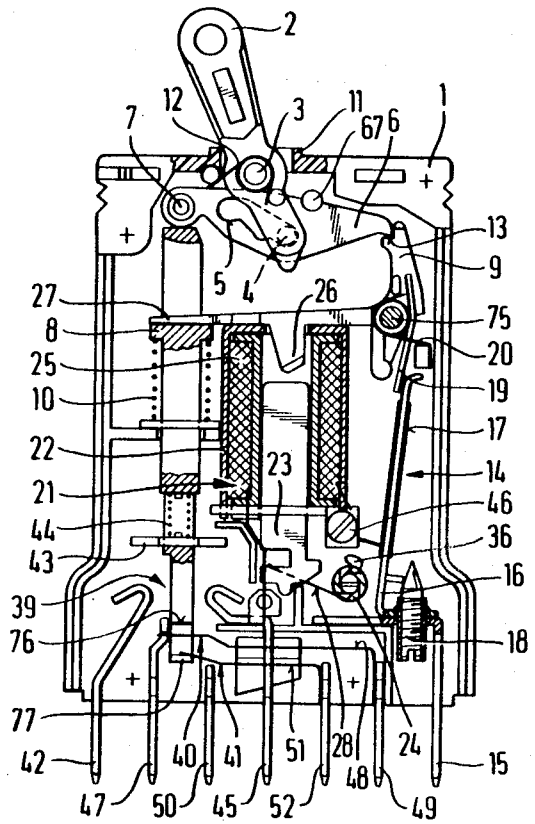
Figure 6:
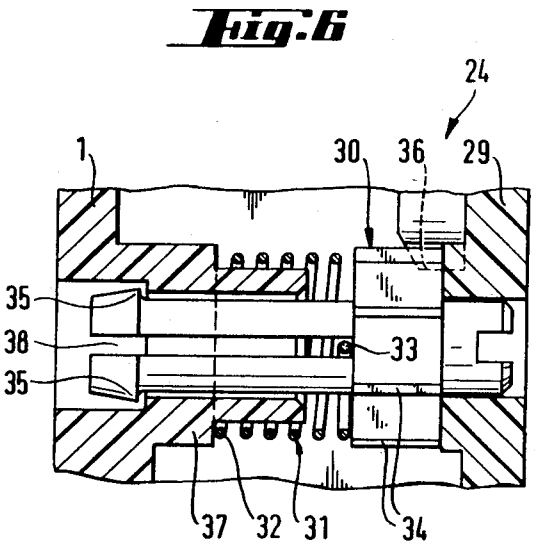
Figure 5:
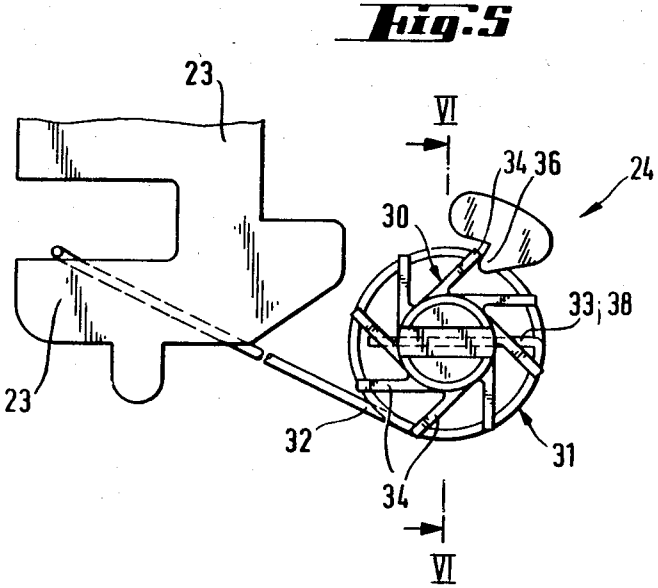
Figure 7:
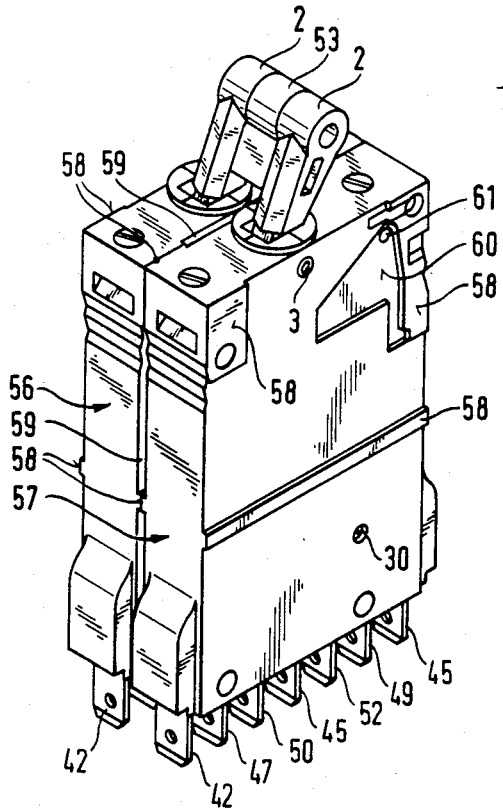
Figure 8:
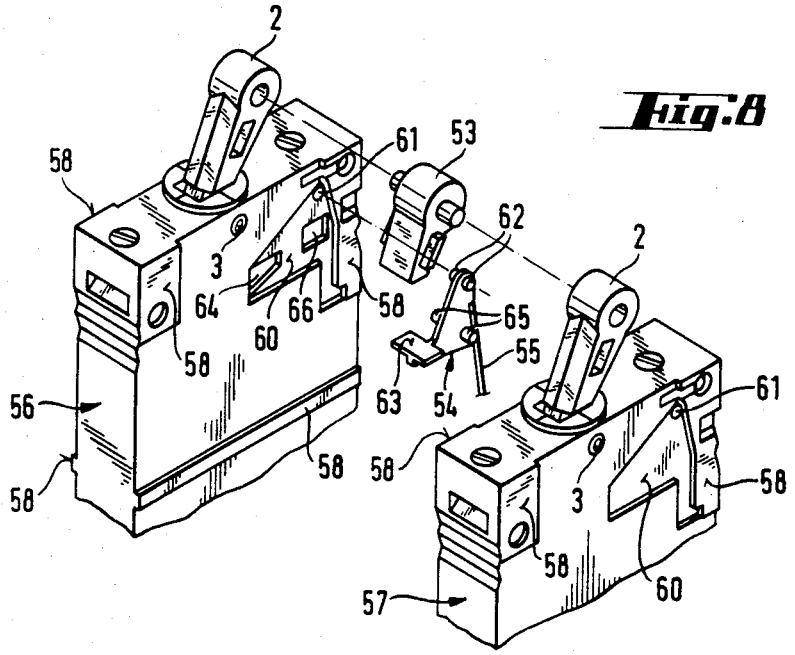
Figure 9:
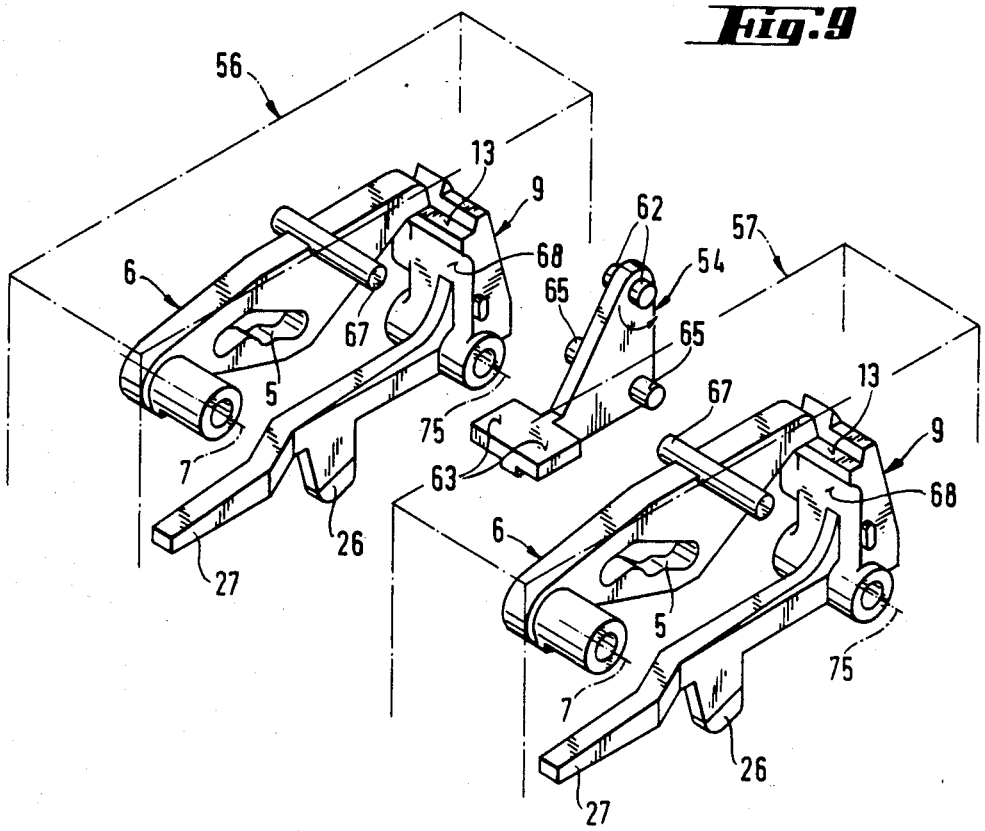

The invention is explained in greater detail, with the aid of an illustrative embodiment, in FIGS. 1–8 in which all components essential to the invention are provided with reference designations and in which:

FIG. 1 shows a top view of the overcurrent protection switch, with the upper part removed, in the on position, FIG. 2 shows a view as in FIG. 1 of the overcurrent protection switch, but in the intermediate position, FIG. 3 shows a view as in FIGS. 1 and 2 of the overcurrent protection switch, but in the off position, FIG. 4 shows an off position of the overcurrent protection switch with free tripping, FIG. 5 shows a detail of the adjustment for the magnetic trip as in area V of FIG. 1, FIG. 6 shows a section according to FIG. 5 of the detail of the adjustment along plane VI–VI, FIG. 7 shows a combination of two individual apparatuses to form a two-pole overcurrent protection switch, FIG. 8 shows a perspective exploded view of the individual parts for coupling to apparatuses, FIG. 9 shows a perspective exploded view of the individual parts for coupling the trip levers.

The description is divided into the sections

Switch latch

Trip elements

Switching contacts
Coupling

THE SWITCH LATCH (FIGS. 1–4)

The housing of the overcurrent protection switch consists of two housing halves of plastic (here of thermoplastic which is, leakage current-resistant and flame-resistant) of which in the figures the lower housing part 1 is shown. The apparatus is actuated by the toggle 2 which is supported with the shaft 3 formed in one piece with the toggle in the upper and lower piece of the housing. At the lower end of the toggle 2 a guide pin 4 is mounted which engages through a gate-type guide 5 of the latching lever 6.

The latching lever 6 is supported by means of a shaft 7 to be movable in the housing parts. The side with the shaft 7 pushes the plunger 8 downwards in the on position (FIG. 1). The other end of the latching lever 6 rests on the trip lever 9 which is supported to be swivellable on the shaft 75 which is stationary with respect to the housing. Lever 9 is essentially L-shaped in that the arm bearing end 27 and the arm bearing support area 13 essentially form an "L".

In the on position as shown in FIG. 1, the plunger 8 is pushed downwardly by the toggle 2 and its guide pin 4 via the gate-type guide 5 of the latching levers 6 due to the fact that these are supported on the trip lever 9. The compression spring 10 at the plunger 8 counteracts the latching lever 6 and thus generates a clockwise torque acting on the toggle 2 via its guide pin 4 (FIG. 1). The stop 11 in the housing causes the on position to be maintained in spite of the torsion-type leg spring 12. The torsion-type leg spring 12 exerts a counter-clockwise rotational torque on the toggle 2 but has less power in the on position.

The intermediate position shown in FIG. 2 is in practice based on the same considerations as those of FIG. 1. As a result of the shape of the guide 5 (5), however, the plunger 8 can move further upwards. This affects the position of the contact bridges which will be discussed later. The force of the torsion-type leg spring is less also in this case so that the toggle 2 remains in this intermediate position.

In the off position of FIG. 3, the compression spring 10 can push the latching lever 6 fully upward. At the same time the force of the torsion-type leg spring 12 now dominates so that the latching lever 6 comes to rest on the side of the trip lever 9 via its support area 13. When the toggle 2 is actuated into the on position, the latching lever 6 is first pushed onto the support area 13 and only then the plunger 8 can be pushed downwards.

The intermediate position of FIG. 2 can be reached both from the off position and from the on position.

When the trip lever 9 moves to turn clockwise the support area 13 moves clear of the latching lever 6. The compression spring 10 can now turn the latching lever 6 clockwise around axis 4. The toggle 2 can now be held in the on position as is shown in FIG. 4. Independently of this the plunger 8 moves upwards. If the toggle 2 is unimpeded the compression spring 10, after 9/6 have been tripped, has no further influence on the torsion-type leg spring 12 so that the toggle 2 is moved by the torsion-type leg spring 12 into the off position. The latching lever 6 assumes the position of FIG. 3 in the final position.

THE TRIP ELEMENTS (FIGS. 1–4)

The overcurrent protection switch is provided with both a bimetallic and a magnetic coil trip. Each of these is in itself fully effective which means that the overcurrent protection switch can also be produced with only one trip.

The bimetallic trip 14 consists essentially of the following parts:

- connection 15;
- bimetallic strip 16 which is riveted (or welded) onto the connection 15;
- heater winding 17, wound around the bimetallic strip 16 by interposition of an insulating material (for example mica);
- adjustment 18 by means of an adjusting screw acting on a projection of the bimetallic strip.

The heating causes the bimetallic strip 16 to bend to the left and to press against the compensating bimetallic strip 19. The latter is attached to the trip lever 9.

As a result of the pressure of the bimetallic strip the trip lever 9 is moved clockwise until the latching lever 6 is unlatched. The leg spring 20 counteracts the force of the bimetallic strip and brings the trip lever into its rest position as shown in FIGS. 1–3.

The magnetic trip 21 consists of the following parts:

- magnetic circuit consisting of magnetic yoke 22 and armature 23,
- adjustment 24
- magnetic coil 25.

With large overcurrents (short circuit) the armature 23 is pulled upward by the force of the magnetic flux. After a certain amount of free travel it presses against a projection 26 of the trip lever 9. This, in turn, is turned clockwise and effects the unlatching (FIG. 4).

As a result of the high acceleration of the armature 23 another additional force can be exerted in the off direction on the plunger 8 via the swivel end 27 of the trip lever 9. This is of importance within the context of high switching capacity for rapid contact opening.

The response value and thus the trip characteristic can be influenced by two measures:

- omission of the magnetic yoke 22; this delays the response value.
- changing the spring force of the torsion/compression-type leg spring 31 by means of the adjustment 24. This is more a fine adjustment.

FIGS. 5 and 6 serve for explaining the adjustment 24. The adjustment has the following parts:

- adjusting part 30, molded of plastic,
- flexible hooks 35 molded as parts of the adjusting part 30,
- torsion/compression-type leg spring 31 with legs 32 and 33,
- teeth 34, molded as parts of the adjusting part 30,
- projection 36, molded as part of the upper housing part 29,
- land 37, molded as part of the lower housing part 1.

The spring 31 which combines in itself a compression spring and a torsion-type leg spring is pushed onto the land 37. The adjusting part 30 is pushed through the land and the torsion spring until the flexible hooks 35 lock into the lower housing part 1.

In this case the leg 32 of the spring 31 is supported in the armature 23 and the other leg 33 is located in the slot 38 which is formed by the flexible hooks. Since the spring 31 is also a compression spring, the spring 31 is supported between the land 37 and the teeth 34. The flexible hooks 35 hold the adjusting part 30 for as long as the upper part 29 is not placed on.

In the completely assembled apparatus, in each case a tooth 34 is supported on the projection 36 and thus forms a support point for the torsion/compression-type leg spring 31. The other support point is the armature 23.

By turning the adjusting part 30 counter-clockwise, the torsion spring 31 is tensioned and its rotational torque increases. In order to release the tension of the torsion spring 31, the adjusting part 30 is pushed against the lower housing part until the teeth 34 are out of reach of the projection 36 making it thus possible to carry out the adjustment.

THE SWITCHING CONTACTS

(FIGS. 1–4)

Three circuit breakers are provided in the apparatus:
the primary circuit 39,
the auxiliary circuit—normally closed contact 40,
auxiliary circuit—normally open contact 41.

The primary circuit breaker represents dual contact breaking.

The connection 42 forms the first stationary contact. The contact point itself can consist of copper with surface silver plating or contact material is plated in at the contact point.

In the on position of FIG. 1, the contact bridge 43 rests on the connection 42. The contact bridge is supported via the compression spring 44, in order to generate the necessary contact pressure, at the plunger 8.

The second stationary contact is formed by the connection 45. The circuit breaking position is therefore located between the connections 42 and 45. However, the winding end of the coil 25 is also conductively connected to the connection 45 and the other end of the coil is connected at terminal point 46 with the heater winding 17. The second end of the heater winding is welded to the bimetallic strip.

Thus the current path for the trip elements is located between connection 45 and connection 15.

The normally-closed contact of the auxiliary circuit has a stationary contact at connection 47. In the off position which also serves as the starting position for considering the normally-closed contact the contact spring 48 which is attached to the stationary contact at connection 49 contacts connection 47. Thus the normally-closed contact of the auxiliary circuit is located between connections 47 and 49. The contacts are actuated via member 76 of the plunger 8.

The normally-open contact of the auxiliary circuit has its stationary contact at connection 50. In the off position which again serves as the starting position, the contact point formed by the contact spring 51 is opened. The contact spring 51 is attached to connection 52. The normally-open contact of the auxiliary circuit is located between the connections 50 and 52. The contacts are also actuated by the plunger 8 via its member 77.

In the off position of FIG. 3 the following switching positions exist:

Primary circuit 39/42–45—opened
Auxiliary circuit, normally closed contact 40/47–4-9—closed,
Auxiliary circuit, normally open contact 41/50–5-2—opened.

In the on position of FIG. 1 the following switching positions exist:

Primary circuit 39/42–45—closed,
Auxiliary circuit, normally closed contact 40/47–4-9—opened,
Auxiliary circuit, normally open contact 41/50–52—closed.

In the intermediate position of FIG. 2, the following switching positions exist:

Primary circuit 39/42–45—opened,
Auxiliary circuit, normally closed contact 40/47–4-9—opened,
Auxiliary circuit, normally open contact 41/50–5-2—opened.

In the switching position in the case of free tripping as in FIG. 4, the switching positions correspond to those of the off position.

The auxiliary circuits can also be occupied in a different manner such as, for example, by two normally-closed contacts or two normally-open contacts, and it is possible that other switching positions can be varied also in the intermediate position.

THE COUPLING

(FIGS. 7 and 8)

In FIGS. 7 and 8, two individual apparatuses are coupled together. However, three and more apparatuses can also be coupled to each other.

Coupling is done not only mechanically via the actuating members but the trip levers 9 are also coupled together.

The following parts are required for coupling:
link 53,
trip coupler 54,
spring 55.

If for example two apparatuses (apparatus 56 and 57) are coupled to each other, they rest against each other at the spacing lands 58 and are riveted together by means of rivets. Between the apparatuses hollow spaces 59 form which, on the one hand, accommodate the trip coupler 54 and, on the other hand, also create an air cushion in order to reduce the heat effect of the apparatuses on each other.

Additional recesses 60 are molded into the housings for the trip coupler 54. In hole 61, which exists in both housing parts, the pegs 62 of the trip coupler 54 are supported which coupler thus is located to be rotatable between the two apparatuses. The spring 55 rotates the trip coupler clockwise and brings it to stop with the tongues 63 against the opening 64 in the housing. The pegs 65 also project through an opening 66 in the housing into the apparatuses.

In the on position of FIG. 1, the individual parts are positioned as shown in FIG. 9.

Assuming the apparatus 56 trips, that is to say the trip lever 9 is rotated clockwise, then the latching lever 6 can swivel clockwise around the guide pin 4 as already described. During this process, the peg 67 comes into contact with the tongue 63 of the trip coupler 54. This causes the latter to be rotated downwards or counter-clockwise, respectively (see arrow of rotation). With a rotational movement of the appropriate magnitude the pegs 65 press against the inner surface 68 and thus rotate the trip lever 9 of the apparatus 57 until this apparatus also trips.

The same tripping process occurs if the apparatus 57 is the first to respond.

The description and the illustrations make it clear that several apparatuses can also be coupled to each other. Generally, during a switching-off process a responding apparatus also trips, via the trip coupler, the adjacent apparatus (apparatuses) via its trip lever. If coupled apparatuses are manually actuated then tripping only takes place via the coupling of the toggles 2 via the link 53.

We claim:

1. An overcurrent protection switch comprising:

a pair of switching contacts;

at least one trip element;

a mechanical switch latch composed of an actuating element (2) and a latching lever (6) which acts in conjunction with said actuating element and which has a first end and a second end;

a plunger (8) disposed to be acted upon by said first end and essentially guided, under an initial spring tension, at right angles to said latching level (6) for selectively connecting and disconnecting said pair of switching contacts;

a trip lever (9) movable between an untripped position and a tripped position and having a support area (13) on which said second end of said latching lever (6) rests, under the influence of the initial spring tension on said plunger (8), when said trip lever (9) is in its untripped position, said trip lever being disposed to be moved into its tripped position by said trip element; and a housing containing said switching contacts, said trip element, said mechanical switch latch, said plunger and said trip lever;

wherein said trip lever:

is composed of two arms which extend from a common location to form an "L";

is provided, at the common location, with a pivot which is stationary with respect to said housing;

includes means biassing said trip lever toward its untripped position;

has one of its said arms extending essentially at right angles to said plunger; and has the other of its arms extending essentially parallel to said plunger and toward said actuating element (2), with said support area (13) being disposed at the free end of said other arm; and further wherein:

said plunger (8) is provided with a longitudinal groove in which engages the free end of said one arm of said trip lever (9); and said longitudinal groove has an end constructed to act as a stop for said free end of said one arm of said trip lever (9).

2. An overcurrent protection switch as claimed in claim 1 wherein said trip element is a magnetic trip element having an armature which is movable to act upon said trip lever for moving said trip lever into its tripped position and causing said free end of said one arm of said trip lever to engage said stop and thus move said plunger under the inertia of the movement of said trip lever into its tripped position.

3. An overcurrent protection switch as claimed in claim 1, wherein the latching lever (6) is provided in its center region with a gate-type guide (5) and said actuating element comprises a two-armed toggle movable between an on position and an off position and having one end projecting into said housing, and a guide pin carried at said one end of said toggle engaging in said guide, said guide pin cooperating with said guide such that when said trip lever is in its tripped position said toggle is movable into its off position.

4. An overcurrent protection switch as claimed in claim 3, wherein the gate-type guide (5) is provided with two end indentations associated with the on and off positions of said switch, and with a centrally disposed further indentation, associated with an intermediate position, for the guide pin (4), and the guide pin (4) can be locked in the further indentation, both from the on position and from the off position.

5. An overcurrent protection switch as claimed in claim 4, further comprising additional switching contacts, and wherein all switching contacts acted upon by the plunger (8) are open in the intermediate position.

6. An overcurrent protection switch as claimed in claim 1, wherein the toggle (2), the latching lever (6), the trip lever (9) and the plunger (8) are constructed of plastic and are disposed at a distance from the housing walls which ensures that an insulating air clearance is maintained.

7. An overcurrent protection switch as claimed in claim 2, wherein said magnetic trip element is constructed as a coil former (25) which is surrounded by a yoke (22) and in which said armature (23) can be axially displaced, which latter, in the case of tripping, with its end facing the toggle (2) acts upon the center region of said one arm of said trip lever (9) in order to move said trip lever to its tripped position.

8. An overcurrent protection switch as claimed in claim 7, wherein the yoke (22) is supported to be releasable on the coil former (25).

9. An overcurrent protection switch as claimed in claim 2, wherein said trip element further comprises a spring which subjects said armature (23) to an initial tension in the axial direction facing away from said trip lever (9).

10. An overcurrent protection switch as claimed in claim 9, wherein the spring is constructed as a torsion/-compression-type leg spring (31) which is supported on an adjusting part (30) which can be turned and locked in steps in the housing, the operative end of which spring (32) projects radially away from the adjusting part (30) and is attached to the armature (23) and the fixed end (33) of which is disposed at the adjusting part (30).

11. An overcurrent protection switch as claimed in claim 10, wherein the adjusting part (30) is rotationally supported with one axis in the housing and is provided with a plurality of radially projecting teeth (34) which can be locked behind a housing projection (36).

12. An overcurrent protection switch as claimed in claim 10, wherein the adjusting part (30) can be displaced in the direction of its axis against the axial tension of the torsion/compression-type spring (31).

13. An overcurrent protection switch as claimed in claim 1 further comprising a compensating bimetallic strip (19) having an end which projects from the area of the common location of the trip lever (9), and wherein said trip element is a thermal trip element constructed as a bimetallic strip (16) having a free end disposed to act upon said projection end of said compensating bimetallic strip.

14. Two overcurrent protection switches, each as claimed in claim 1, disposed adjacent one another, with said housings of said two switches having side faces which form a hollow space (59) which is predetermined by spacing lands (58) and in which is disposed a trip coupler (54) for coupling the trip movements of adjacent switch latches.

15. An overcurrent protection switch as claimed in claim 14, wherein the trip coupler (54) has first and second legs and is constructed to be essentially L-shaped and is provided at the end of its first leg with pegs for being rotatably supported in housing holes (61), at the end of its second leg with tongues (63) which laterally engage in the adjacent housings and which, in the case of tripping, are acted upon by other pegs (67) which project laterally from the latching levers (6), and wherein in the area of the angle between said legs a third peg (65) is disposed which, in the case of tripping, acts upon the inside faces (68) of said other arms of the trip levers (9).

16. An overcurrent protection switch as claimed in claim 15, wherein the further pegs (67) can be introduced into holes in the latching levers (6).

17. An overcurrent protection switch as claimed in claim 1 further comprising additional switching contacts and wherein all the switching contacts are disposed in the part of the housing facing away from the actuating element (toggle 2) and are formed at least partially by the ends, inside the housing, of connecting contact tongues.

* * * * *